US005210580A

United States Patent [19]

Aslam et al.

[11] Patent Number: 5,210,580

[45] Date of Patent: May 11, 1993

[54] TONER IMAGE FIXING METHOD AND DEVICE IN WHICH A PRESSURE MEMBER IS COOLED

[75] Inventors: Muhammad Aslam; Michael K. Baskin, both of Rochester, N.Y.

[73] Assignee: Eastman Kodak Company, Rochester, N.Y.

[21] Appl. No.: 754,819

[22] Filed: Sep. 3, 1991

[51] Int. Cl.[5] ..... G03G 15/20

[52] U.S. Cl. ..... 355/290; 219/216; 355/285; 355/295; 430/99; 430/124

[58] Field of Search ..... 355/282, 285, 289, 290, 355/295, 208; 219/216; 430/124, 99

[56] References Cited

U.S. PATENT DOCUMENTS

| | | | |
|---|---|---|---|
| 3,465,122 | 9/1969 | Kolless | 219/216 |
| 3,993,124 | 11/1976 | Mueller | 355/35 X |
| 4,082,137 | 4/1978 | Mueller . | |
| 4,085,794 | 4/1978 | Mueller . | |
| 4,092,099 | 5/1978 | Chiba et al. . | |
| 4,963,943 | 10/1990 | Tamary | 355/290 |
| 4,992,833 | 2/1991 | Dermiggio | 355/282 |
| 5,004,891 | 4/1991 | Landis | 219/216 X |
| 5,023,038 | 6/1991 | Aslam et al. . | |

FOREIGN PATENT DOCUMENTS

| | | | |
|---|---|---|---|
| 0049072 | 2/1989 | Japan | 355/289 |

*Primary Examiner*—A. T. Grimley
*Assistant Examiner*—Matthew S. Smith
*Attorney, Agent, or Firm*—Leonard W. Treash

[57] ABSTRACT

A toner image is fixed to a receiving sheet by the application of pressure and heat applied between first and second pressure members. To prevent blistering of finished receiving sheets, a substantial temperature gradient is maintained between the two members which heats the image side of the receiving sheet adequately for fixing without excessively heating the overall sheet. The second pressure member contacting the side of the sheet opposite from the image is actively cooled by an air cooling device or the like as controlled by a logic and control in response to the temperature of the second pressure member.

5 Claims, 3 Drawing Sheets

TONER IMAGE FIXING METHOD AND DEVICE IN WHICH A PRESSURE MEMBER IS COOLED

RELATED APPLICATIONS

This application is related to co-assigned:

U.S. patent application Ser. No. 07/754,489, filed Sep. 3, 1991, now issued as U.S. Pat. No. 5,119,142, IMAGE FIXING DEVICE HAVING HEAT RECYCLING MEANS, in the name of Swapceinski et al.

U.S. patent application Ser. No. 07/754,490, filed Sep. 3,1991, METHOD AND APPARATUS FOR PREHEATING AND PRESSURE-FIXING A TONER IMAGE, in the name of Fainaml et al.

TECHNICAL FIELD

This invention relates to the fixing of toner images, for example, toner images created electrophotographically. It is particularly useful in fixing images on a receiving sheet that has a tendency to blister when subjected to heat and pressure.

BACKGROUND ART

Toner image fixing of some receiving sheets is plagued with the problem of blistering. In most environments, paper based receiving sheets carrying toner images have a certain amount of moisture. When that moisture is heated to 100° C. or greater, it has a tendency to turn into steam, greatly expanding and escaping the paper. Ordinary bond paper is sufficiently porous to allow the escape of the moisture without damage to the paper in ordinary toner fusing. However, paper that is more highly finished often has less porous outside layers as a result of that finishing which block the escape of steam. The steam pushes the outside layer away from the substrate of the receiving sheet creating a blister.

U.S. Pat. No. 5,089,363, issued Feb. 18, 1992 in the name of Rimai et al and U.S. Pat. No. 5,023,038, issued Jun. 11, 1991 in the name of Aslam et al, disclose a method of fixing a multicolor toner image carried on a heat softenable, for example, thermoplastic, outside layer of a receiving sheet. The receiving sheet is passed across a preheating plate to raise the temperature of the heat softenable layer to or above its softening point. It is fed into a pressure nip created by a pressure roller and a belt or web backed by a heated roller. The belt or web is of a hard ferrotyping material such as stainless steel, nickel, or the like. Relatively high pressure is applied between the belt and pressure roller to embed much of the toner image in the heat softenable layer fixing the image. Some of the toner may not be entirely embedded but may be fused on the top layer, but with much of it embedded, the hard ferrotyping belt provides photographic quality with an absence of relief and a high gloss. The toner image and heat softenable layer remain in contact with the belt as it moves away from the pressure nip. The belt and sheet are allowed to cool until the heat softenable layer and toner image are below their glass transition temperatures. At this point the sheet can be separated without offset. All this is accomplished without the use of offset preventing liquids which would reduce the quality of the image. This method is especially useful for very small particle color toner images.

The preheating step and the above process has a tendency to drive some of the moisture out of the paper before the receiving sheet enters the nip. This process can be gentle enough to not cause blistering. However, if moisture remains in the paper in the nip, it is constrained by the nip from escaping and then may blister the sheet as the sheet leaves the nip.

Conventional fixing without the benefit of the heat softenable layer but still using a finished receiving sheet that has a tendency to blister may actually present more problems than the materials in the above prior applications. Without the heat softenable layer it may be necessary to raise a high quality toner to a temperature of between 120° and 150° C. to accomplish fixing. This is done over a substantially wider pressure nip which constrains the receiving sheet over a longer period of time without allowing the escape of steam. Again, when the sheet leaves the nip the constrained moisture which is now turned to steam escapes more rapidly than the porosity of the receiving sheet layers can handle and the sheet blisters.

U.S. Pat. No. 4,963,943 to Tamary issued Oct. 16, 1990 suggests cooling the pressure roller (contacting the back of the sheet) in response to a fixing apparatus entering a "standby" mode which cooling step is deactivated when the apparatus goes back into a "run" mode. This approach prevents overheating of the fusing roller (contacting the image) which among other benefits reduces the tendency of the receiving sheets to blister. See also U.S. Pat. Nos. 3,993,124; 4,082,137; 4,085,794 and 4,092,099.

DISCLOSURE OF THE INVENTION

It is an object of the invention to fix toner images carried on a first side of a receiving sheet which receiving sheet has first and second sides, with a reduced risk of blistering of the sheet.

This and other objects are accomplished by feeding the receiving sheet into a nip between first and second pressure members. The first pressure member contacts the first side of the receiving sheet and is heated to a temperature sufficient to fix the toner image. The second pressure member contacts the second side of the receiving sheet. The second pressure member is cooled during operation to a temperature substantially below the temperature of the first pressure member to provide a substantial temperature gradient between the first and second sides of the receiving sheet. With this temperature gradient, the toner image (or a heat softenable layer carrying the toner image, if one is used) can be heated to the temperature necessary to fix the image without actually heating the moisture in the receiving sheet to a temperature making it likely to blister the sheet.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

The invention is usable in any fixing method or device for fixing a toner image to a receiving sheet which receiving sheet has a tendency to blister. As dry electrophotographic processes become higher quality, there is a tendency to make use of that quality by using a higher finished receiving sheet. Typically such receiving sheets have less porosity at their surfaces than do the traditional bond paper used for copying. This lower porosity at the surface resists the escape of steam from moisture in the paper when heated in the fusing process.

Applicants have solved the problem of blistering by maintaining a substantial difference in the surface temperatures of the pressure members contacting the opposite sides of the sheets. This difference in temperatures of the pressure members causes a temperature gradient across the receiving sheet which permits the image carrying surface to be substantially hotter than the rest of the sheet. Thus, the image and/or the image carrying surface is raised to a temperature suitable for fusing, while much of the moisture in the receiving sheet is not raised to a temperature which causes blistering.

Figure 1:
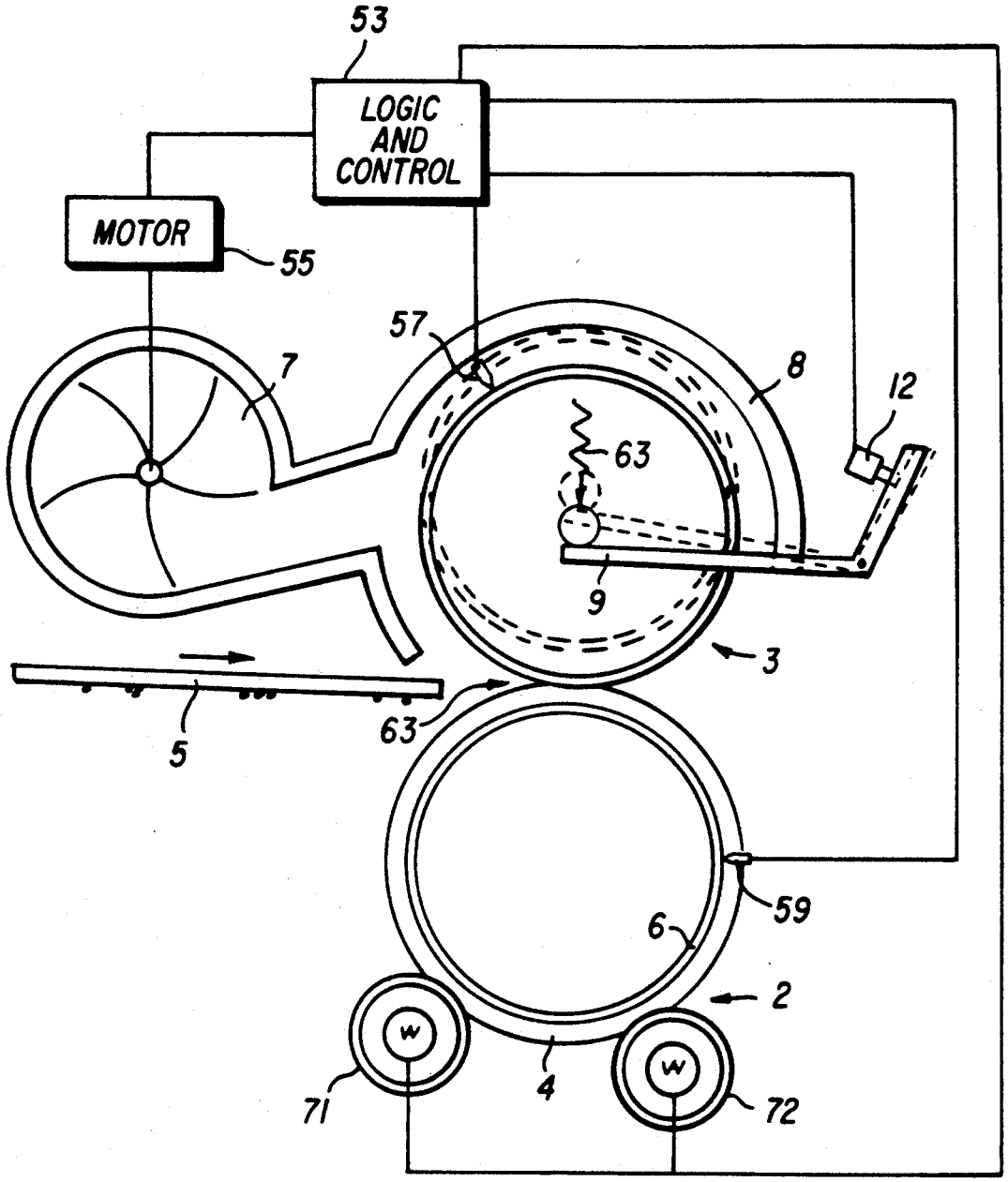
FIG. 1 is a front schematic of a fixing device constructed according to the invention.

According to FIG. 1, this method and apparatus is demonstrated in a fixing device which includes a first pressure member, for example, a heated fusing roller 2 and a second pressure member, for example, a pressure roller 3. Rollers 2 and 3 are urged together by appropriate means, shown schematically as a spring 61 to provide a nip 63 into which a receiving sheet 5 carrying toner on a first or bottom side is fed.

Heated roller 2 has an aluminum core 6 and an elastomeric outer layer 4 which is heated by heating rollers 71 and 72 which contact the outside surface of roller 2. A heat insulating layer may be interposed between aluminum core 6 and elastomeric core 4 to prevent heat loss.

Pressure roller 3 is separatable from heated roller 2 by a separation mechanism 9 actuable by a solenoid 12.

Pressure roller 3 is cooled by an air cooling mechanism which includes a fan 7 powered by a motor 55 which feeds cooling air across a portion of pressure roller 3 as controlled by a shroud 8 which conforms generally to the curvature of roller 3.

Temperature sensing devices 57 and 59 sense the surface temperatures of the pressure roller 3 and the core 6 of fusing roller 2. A logic and control 53 controls the operation of the fixing device and can control as well the rest of the apparatus in which the fixing device is situate.

In operation, a receiving sheet 5 having a toner image on its underside is fed into nip 63. Contact with the surface of heated roller 2 in nip 63 heats the toner image sufficiently that, in combination with the pressure from rollers 2 and 3 the image is fused to receiving sheet 5.

The temperatures of the rollers 2 and 3 are monitored by sensing devices 59 and 57 and fed to logic and control 53. Heating devices 71 and 72 are controlled as known in the art, to maintain the temperature of fusing roll 2 above a predetermined minimum necessary for fixing. Also as is well known in the art, fusing roll 2 would be maintained below a predetermined maximum temperature to prevent charring of the paper and to inhibit blistering.

However, to allow the temperature of roller 2 to be relatively high without blistering of the receiving sheet, the temperature of pressure roller 3 is maintained below a predetermined maximum temperature substantially below that of heated roller 2. Preferably, the temperature of pressure roller 3 is maintained more than 40° C. below that of heated fusing roller 2. This is accomplished by monitoring the temperature of pressure roller 3 with sensor 57 and in response to the temperature of pressure roller 3 reaching the maximum temperature, activating motor 55 to drive the fan 7 to force cooling air around pressure roller 3 to reduce its temperature. The process can also be assisted by separating the rollers when no sheet is in the nip to prevent the pressure roller 3 from becoming heated by contact with heating roller 2 to a degree more than the air cooling device can handle.

Examples of the invention were carried out with a hard, air cooled pressure roller and an internally heated fusing roller having an elastomeric outer layer similar to that shown in FIG. 1. A color toner image made up of a polyester toner having a glass transition temperature of approximately 60° C. was transferred to receiving sheet of laser print paper having a glossy, clay based finish on both surfaces. The receiving sheet was fed into a fuser with a variable temperature control on each roller. Using a heated roller whose temperature was maintained at 182° C. and an air cooled pressure roller whose temperature was maintained at not more than 132° C., images were fused without substantial blistering of the receiving sheet. Using the same type of toner image on the same type of receiving sheet but allowing the temperature on the pressure roller to increase to 138° C., blistering occurred even though the fusing temperature was reduced to 165° C. At heated roller temperatures below 165° C.,, complete fusing was not obtained.

The above examples are dependent upon not only the materials used but the size of the nip which determines the temperature to which the surfaces of the receiving sheet are raised. However, it clearly demonstrates that with a substantial temperature gradient across the receiving sheet fusing can be accomplished without blistering with materials that would otherwise blister. It also demonstrates that active cooling of the pressure roller in response to careful temperature monitoring is useful in preventing blistering.

Figure 2:
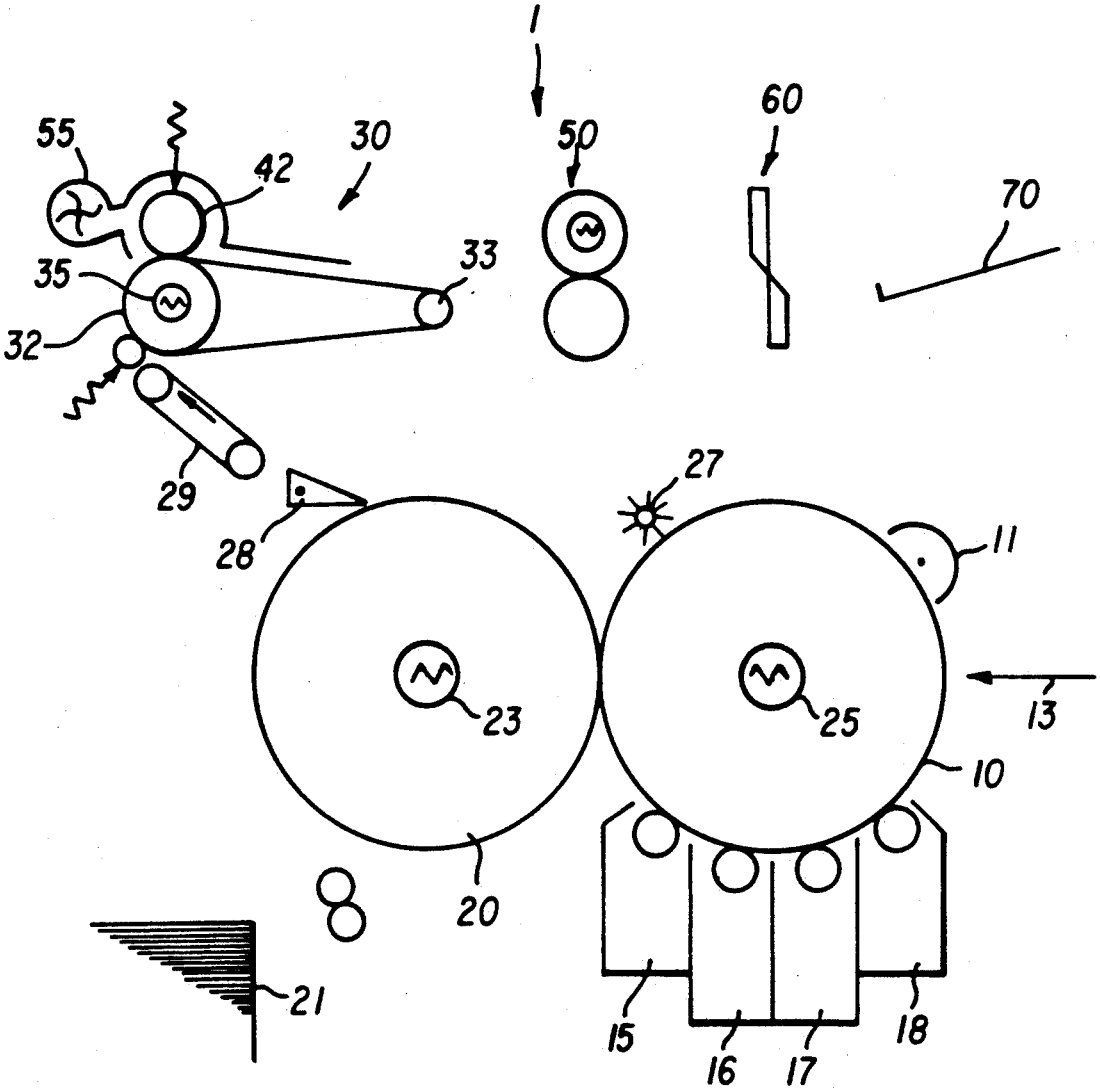
FIG. 2 is a front schematic of an electrophotographic color image forming apparatus in which the fixing device constructed according to the invention is particularly usable.
Figure 3:
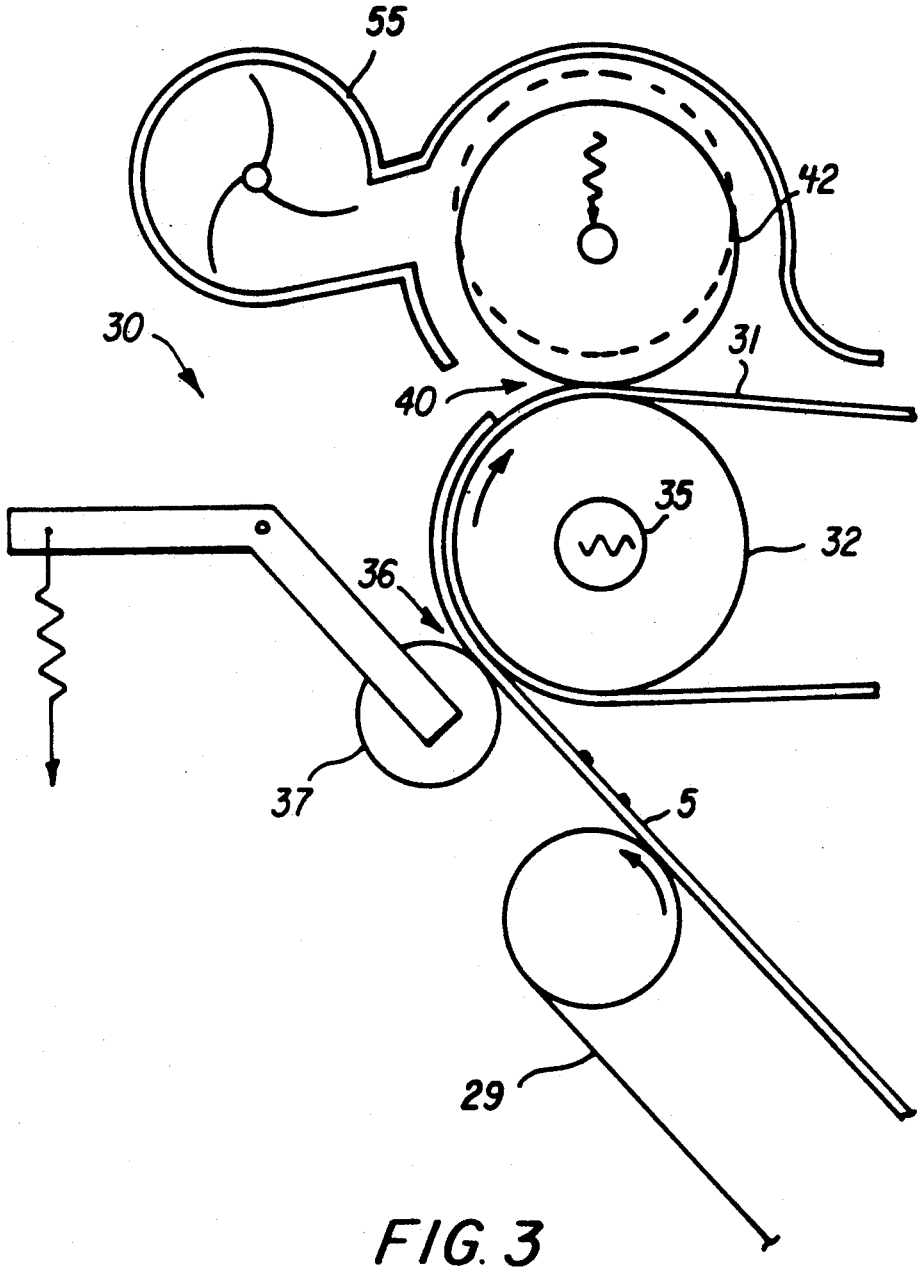
FIG. 3 is an enlarged front schematic of a portion of a fixing device component of the image forming apparatus shown in FIG. 2.

FIGS. 2 and 3 illustrate another embodiment of the invention.

FIG. 2 illustrates an apparatus in which the FIGS. 2 and 3 embodiment of the invention is particularly useful. According thereto, color electrophotographic apparatus 1 includes an image member 10 having an outside or peripheral image surface on which a series of different color toner images are formed. The image surface can include various photoconductive and other layers making it electrophotosensitive and usable in electrophotography. It is uniformly charged at a charging station 11. The charged surface is imagewise exposed in an exposure station, for example, laser 13 to create a series of electrostatic images. Electrostatic images are each toned by a different one of toning stations 15, 16, 17 and 18 which contain different color toners to create a series of different color toner images. Different color toner images are transferred in registration to a receiving sheet 5 (FIG. 3) to form a multicolor image. The receiving sheet is fed from a receiving sheet supply 21 and secured to the outside surface of a transfer drum 20.

The receiving sheet has a heat softenable outside layer on a first or image side, to which the images are transferred. For example, the heat softenable outside layer can be a polyester having a glass transition temperature of approximately 60° C. In order to prevent curl of the sheet because of the heat softenable layer, the opposite or second side of the sheet also has a thermoplastic coating, for example, a polyethylene or polypropylene having a high melting point, for example, in excess of 120° C. Both layers tend to resist the escape of steam from the receiving sheet.

Transfer is effected by heating the heat softenable layer, for example, by use of a lamp 23 located inside transfer drum 20. Image member 10 may also be heated to assist in the process by a lamp 25 but should not be heated to a temperature that would cause the toner to stick to the surface of image member 10 or affect the light sensitive properties of the photoconductive layers. Transfer drum 20 is rotated once for each color image to be transferred, to cause the receiving sheet to receive the color images in registration, creating a multicolor image partially embedded in the heat softenable outside layer. Image member 10 is cleaned by cleaning device 27 for reuse.

When all images have been transferred to the receiving sheet it is stripped from transfer drum 10 by an articulatable skive 28 and transported by a suitable transport 29 to a fixing device 30. The multicolor toner image is fixed by fixing device 30 utilizing a combination of pressure and heat as shown with respect to FIG. 3. The toner image can be further treated by a texturizing or a glossing device 50. It may also be cut into smaller images by a slitting, chopping or other device 60 and ultimately deposited in output tray 70.

Transport device 29 is shown in FIG. 2 as a relatively short transport belt. If fuser 30 is to operate at a slower speed than transfer drum 20, the distance between transfer drum 20 and fuser 30 needs to be longer than the longest sheet, or a loop or other provision for taking slack in the sheet must be provided, all of which are well known in the art.

Referring to FIGS. 2 and 3, fixing device 30 includes a ferrotyping belt 31 which is trained primarily around a pair of rollers including a heated roller 32 and a separation roller 33. Belt 31 can be any of a number of hard materials, including nickel, stainless steel and other metals, polyethylene, polypropylene and other high melting point plastics. It may be covered by a release material such as certain silicones, polyamides, or fluorocarbons. For highest quality work, no release liquid is used. Heated roller 32 is heated by an internal lamp 35. A pressure roller 42 is spring-urged into contact with belt 31 where belt 31 is backed by heated roller 32 forming a high pressure nip 40.

Receiving sheet 5 is transported by transport device 29 with the toner image partially embedded in the thermoplastic layer on the first side of the receiving sheet 5 facing away from transport 29. Receiving sheet 5 is fed by transport 29 into a nip 36 between a scuff roller 37 and belt 31 where belt 31 is backed by heated roller 32. Nip 36 is substantially separated from the high pressure nip 40 between pressure roller 42 and belt 31. Scuff roller 37 urges receiving sheet 5 against belt 31 which preheats both the heat softenable layer and the toner image and as it is carried toward nip 40. The tackiness of the heat softenable layer causes the receiving sheet 5 to adhere to belt 31 thereby assuring its entrance into nip 40.

Heated roller 32 is a hard aluminum roller. Pressure roller 42 can be a hard roller as in FIG. 1 or have a slightly compliant outer layer, for example, an elastomeric outer layer of approximately 50 mils. Pressure roller 42 is spring-urged against belt 31 and heated roller 32 with sufficient pressure to fix the toner image in or on the heat softened outer layer of receiving sheet 5. For example, pressures from 100 to over 1000 pounds per square inch can be used.

As in the FIG. 1 example, to prevent blistering, an air cooling device 55 maintains the surface temperature of pressure roller 42 substantially below that of belt 31 and pressure roller 42 is separatable from belt 31 between images.

As the receiving sheet 5 is carried by belt 31 toward separation roller 33, it is allowed to cool, with the heat softenable layer and the toner image cooling below its glass transition temperature before reaching separation roller 33. This cooling can be aided by maintaining the flow of air from air cooling device 55 and directing it along the sheet and the surface of belt 31 as the sheet continues toward separation. After the heat softenable layer and toner image have cooled the receiving sheet can be separated from belt 31, for example, as belt 31 goes around small separation roller 33. The receiving sheet then continues on to be finished by components 50 and 60 ultimately ending up in hopper 70.

Note that in this example the toner image bearing side of the receiving sheet 5 contacts only the heated belt 31 through the preheating and pressure applying steps. Prior preheating devices which contact the opposite side of the sheet in order not to disturb the toner image make difficult providing the desired temperature gradient in nip 40 because they heat the side of the sheet opposite the image and act counter to cooling device 55.

The invention has been described in detail with particular reference to a preferred embodiment thereof, but it will be understood that variations and modifications can be effected within the spirit and scope of the invention as described hereinabove and as defined in the appended claims.

We claim:

1. An image forming method comprising:

forming a toner image on a first side of a receiving sheet having first and second opposite sides, said first side having an outside heat softenable layer upon which the toner image is formed, feeding said receiving sheet into a nip between said first and second pressure members, said first pressure member contacting the image and being heated to a temperature sufficient to soften said heat softenable layer and to fix said toner image by at least partially embedding said toner image in said heat softenable layer as a result of the pressure in said nip, and said second pressure member contacting the second side of said receiving sheet, and maintaining said second pressure member at a temperature substantially below the temperature of the first pressure member at least while the receiving sheet is in the nip to provide a temperature gradient greater than 40° C. between the first and second sides of the receiving sheet.

2. The method according to claim 1 further including the step of monitoring the temperature of the second pressure member and actively cooling said second member when its temperature reaches or exceeds a predetermined level.

3. The method according to claim 1 wherein said first pressure member is a hard belt backed by a hard roller which hard roller is internally heated and said method includes the step of maintaining contact between the heat softenable layer and the belt after the receiving sheet leaves the nip.

4. The method according to claim 1 wherein said first and second pressure members are first and second rollers and said method includes monitoring the temperature of each roller and maintaining said first member above a first predetermined temperature, and maintaining said second pressure member below a second predetermined temperature said first predetermined temperature being at least 40° C. above the second predetermined temperature.

5. An image forming method comprising:

forming a toner image on a first side of a receiving sheet having first and second opposite sides, said first side having an outside heat softenable layer upon which the toner image is formed, feeding said receiving sheet first into contact with a first pressure member and then into a nip between said first pressure member and a second pressure member, said first pressure member contacting the image and being heated to a temperature sufficient to soften said heat softenable layer prior to said image entering the nip, and to fix said toner image by at least partially embedding said toner image in said heat softenable layer as a result of the pressure in said nip, and said second pressure member contacting the second side of said receiving sheet, and maintaining said second pressure member at a temperature substantially below the temperature of the first pressure member at least while the receiving sheet is in the nip to provide a substantial temperature gradient between the first and second sides of the receiving sheet.

* * * * *